US007832460B2

(12) United States Patent
Arvedi

(10) Patent No.: US 7,832,460 B2
(45) Date of Patent: Nov. 16, 2010

(54) PROCESS AND SYSTEM FOR MANUFACTURING METAL STRIPS AND SHEETS WITHOUT DISCONTINUITY BETWEEN CONTINUOUS CASTING AND ROLLING

(76) Inventor: Giovanni Arvedi, Via Mercatello 26, Cremona (IT) 26100

( * ) Notice: Subject to any disclaimer, the term of this patent is extended or adjusted under 35 U.S.C. 154(b) by 180 days.

(21) Appl. No.: 11/720,172

(22) PCT Filed: Apr. 7, 2005

(86) PCT No.: PCT/IB2005/000915

§ 371 (c)(1),
(2), (4) Date: May 24, 2007

(87) PCT Pub. No.: WO2006/106376

PCT Pub. Date: Oct. 12, 2006

(65) Prior Publication Data

US 2008/0035301 A1 Feb. 14, 2008

(51) Int. Cl.
*B22D 11/22* (2006.01)

(52) U.S. Cl. ..... 164/455

(58) Field of Classification Search ..... 164/455
See application file for complete search history.

(56) References Cited

U.S. PATENT DOCUMENTS 4,962,808 A 10/1990 Hoffken
5,630,467 A * 5/1997 Yoshimura et al. ..... 164/486
6,092,586 A * 7/2000 Schonbeck ..... 164/476

FOREIGN PATENT DOCUMENTS

| | | | |
|---|---|---|---|
| DE | 3712537 | A1 | 11/1988 |
| EP | 0353402 | A1 | 2/1990 |
| EP | 0415787 | A1 | 3/1991 |
| EP | 0415987 | B2 | 12/1992 |
| EP | 0823294 | A1 | 2/1998 |
| EP | 0889762 | B1 | 10/1999 |
| WO | WO 97/48512 | A1 | 12/1997 |
| WO | WO 98/20997 | A1 | 5/1998 |
| WO | WO 99/07499 | A1 | 2/1999 |
| WO | WO 2004/026497 | A1 | 4/2004 |

* cited by examiner

*Primary Examiner*—Jessica L Ward
*Assistant Examiner*—Nicholas P D'Aniello
(74) *Attorney, Agent, or Firm*—Volpe and Koenig, P.C.

(57) ABSTRACT

A process and system for manufacturing metal strips of 0.14-20 mm thickness and metal sheets of 10-100 mm thickness from slabs of thickness between 30 and 300 mm by continuous casting of the bow type. The slab upon casting is fed without discontinuity directly to the rolling step after heating in an induction furnace without any intermediate product. The rolled flat product is withdrawn as sheet upon controlled cooling, by means of cutting and withdrawal device or wound on a reel to form a coil of a continuous strip severable by cutting device downstream of a cooling system. Surface cooling devices can be provided between rolling stands. The feed speed from continuous casting to the end of rolling is increasing step by step in relation to the thickness reductions and the quality of the end product, with regulation in cascade to the downstream direction.

3 Claims, 3 Drawing Sheets

| | IN IH | OUT IH | OUT DES. | IN V1 | OUT V1 | OUT V2 | OUT V3 | OUT V4 | OUT V5 | OUT V6 | OUT V7 | |
|---|---|---|---|---|---|---|---|---|---|---|---|---|
| THICKNESS | 70 | 70 | 70 | 70 | 31,5 | 14,8 | 7,4 | 3,7 | 2,0 | 1,3 | 1,84 | mm |
| REDUCTION | | | | | 55% | 53% | 50% | 50% | 45% | 35% | 24% | % |
| TEMPERATURE | 1150 | 1250 | 1120 | 1098 | 1082 | 1031 | 979 | 937 | 934 | 917 | 883 | °C |
| SPEED | 6,5m/min | 6,5 | | | 0,24 | 0,51 | 1,02 | 2,05 | 3,73 | 5,73 | 7,54 | m/s |

| | IN IH | OUT IH | OUT DES. | IN V1 | OUT V1 | OUT V2 | OUT V3 | OUT V4 | OUT V5 | OUT V6 | OUT V7 | |
|---|---|---|---|---|---|---|---|---|---|---|---|---|
| THICKNESS | 70 | 70 | 70 | 70 | 31,5 | 14,8 | 7,4 | 3,7 | 2,0 | 1,3 | 1,84 | mm |
| REDUCTION | | | | | 55% | 53% | 50% | 50% | 45% | 35% | 24% | % |
| TEMPERATURE | 1150 | 1250 | 1120 | 1098 | 1082 | 1031 | 979 | 937 | 934 | 917 | 883 | °C |
| SPEED | 6,5m/min | 6,5 | | | 0,24 | 0,51 | 1,02 | 2,05 | 3,73 | 5,73 | 7,54 | m/s |

PROCESS AND SYSTEM FOR MANUFACTURING METAL STRIPS AND SHEETS WITHOUT DISCONTINUITY BETWEEN CONTINUOUS CASTING AND ROLLING

FIELD OF THE INVENTION

The present invention relates to a process and relevant system for manufacturing metal strips and sheets without discontinuity from the continuous casting of the melt until the last rolling stand, in particular for steel flat products, without any provision of intermediate products.

BACKGROUND

It is known that in the steel industry, when considering the substantial increase experienced both in costs of row material and of the power employed, and the greater competitivity required by the global market, as well as the increasingly restrictions in the anti-pollution standards to be adopted, it is particularly felt the need of a method for manufacturing hot rolled, high quality coils and sheets, that requires lower costs of investments and production, thus giving rise to thinner and thinner thicknesses of the produced strip. A consequence thereof is that higher competitivity can be given also to the industry of transformation of the end product with lower consumptions of power, thus reducing to a minimum also the harmful impact on the environment.

Meaningful steps in this direction have been made by the technology of the last years, as shown by patents EP 0415987, 0925132, 0946316, 1011896, all in the name of the present applicant, like also the international publication WO 2004/0262497.

However, the results obtained so far, although optimal as far as the product quality is concerned (especially for the steel strips), have turned out to be improvable under the aspect of the lay-out compactness and of the energy saving, as well as of the possible enlargement of the range of flat products that can be obtained.

If in fact the so-called concept of "Cast Rolling" is for example considered, which is already present in the above-mentioned EP 0415787 in the first step of the process only and with only one rolling stand provided on the bow-shaped caster, the consequence was an intermediate product which, after a heating step, required a second rolling step.

Also in the more recent WO 2004/026497 the above-mentioned "Cast Rolling Technology" joins the continuous casting with a first rolling step, formed of not more than four stands to obtain an intermediate product that subsequently is cut and, after a heating step, is further processed with a plastic stretching and a second rolling step. According to the same publication WO 2004/026497 it is also provided the possibility of withdrawing sheets after the first roughing step, but without a controlled cooling system, as required for producing high-quality sheets. In practice the possibility of withdrawing sheets has only the function of a buffer in case of failures in the downstream process in order to avoid stops of the continuous casting and consequently of the line production, but with no relation to programmed production of sheets.

The same concept of "Cast Rolling" was also present in EP 0823294 which however provided for three distinct manufacturing steps: one first step of roughing in austenitic phase giving rise to an intermediate product; a second step of intensive heating of such an intermediate product up to temperatures <738° C., with phase transformation in the Fe/C diagram; and a third step of finishing rolling in the ferritic phase.

The teaching of this prior document is substantially that of applying the concept of cast rolling to obtain a strip of thin thickness in three distinct process steps, the last of which is exclusively in the ferritic phase, thus excluding that the so-called "mass flow" (in other words the quantity of steel flowing in the time unit at the outlet of continuous casting) may be such to allow that an ultrathin product can be obtained in a single manufacturing step totally in the austenitic field.

Also patent EP 0889762 discloses how to apply the cast rolling concept for manufacturing thin strips in one single step without discontinuity and teaches how to combine the manufacturing step in continuous casting of a slab having high mass flow (thickness of the slab in meters multiplied by the outlet speed in m/min>0.487 $m^2$/min) and a high temperature (about 1240° C.) at the outlet of the continuous casting itself, with the rolling step after a temperature homogenization step.

As already done in EP 0823294 also in EP 0889762 there is taught in fact how a cooling step or, in alternative, a heating step can be provided between the first roughing stands and the last finishing stands. Simulations and tests have made clear that the teaching of this patent cannot be applied on industrial scale. The idea of having at the continuous casting outlet a high temperature (about 1400° C.) in order to exploit as much as possible the thermal mass in the subsequent rolling step is in fact certainly interesting but not feasible in practice, because it has been found that feasible casting a slab with high mass flow, at such a high temperature that the surface temperature at the continuous casting outlet is higher than 1150° C., results in irregularities in the meniscus region, thus causing defects in the slab and more risks of break-out.

SUMMARY

The present invention overcomes this problem mainly through a new secondary cooling system being designed for a high mass flow and by providing induction heating to have the slab temperature higher by at least 100° C.

Object of the present invention is that of providing a manufacturing process being able to obtain, with an extremely compact plant in a single continuous step between continuous casting and rolling without intermediate products, hot rolled strips, even of ultrathin thickness, from a maximum of 20 mm until 0.14 mm and high quality sheets, between 10 and 100 mm of thickness, with the greatest utilization of the whole energy provided by the melted metal.

The process according to the present invention, the main features of which are set forth in claim 1, essentially comprises a continuous casting step and a subsequent in-line rolling step, directly connected without intermediate roughing, with an induction heating between continuous casting and rolling.

Another object of the present invention is that of providing a system or plant for carry out the said process, wherein the rolling stands work, without material discontinuity, downstream of the mould and the continuous casting, after an induction furnace, with a minimum distance between outlet from the continuous casting and the first rolling stand. The main features of such a plant are set forth in claim 4.

BRIEF DESCRIPTION OF THE DRAWINGS

Further aspects and features of the present invention, as recited in the dependent claims, will be clearer from the following detailed description of a preferred embodiment of the plant, given in the following with reference to the annexed drawings in which:

DETAILED DESCRIPTION OF THE PREFERRED EMBODIMENTS

It should be noted that the description is substantially directed to the production of steel sheets and/or thin and ultrathin strips, of the carbon or stainless type, but the invention could also be applied to the production of strips or sheets of aluminum, copper or titanium.

As it is known, the melt (molten steel) is poured from the ladle into a tundish and therefrom into the continuous casting mould at thickness of the slab at the outlet that is already reduced with respect to the thickness at the mould inlet, comprised between 30 and 300 mm and a length size between 600 and 4000 mm. The thickness reduction goes on under liquid core conditions, with secondary cooling, in the same casting step, thereby in the rolling stands directly connected to continuous casting until ending by utilizing as much as possible the energy available in the liquid steel at the beginning of the process until reaching the desired thickness, being in the range 0.14-20 mm for the strips and 10-100 mm for the sheets.

Figure 3:
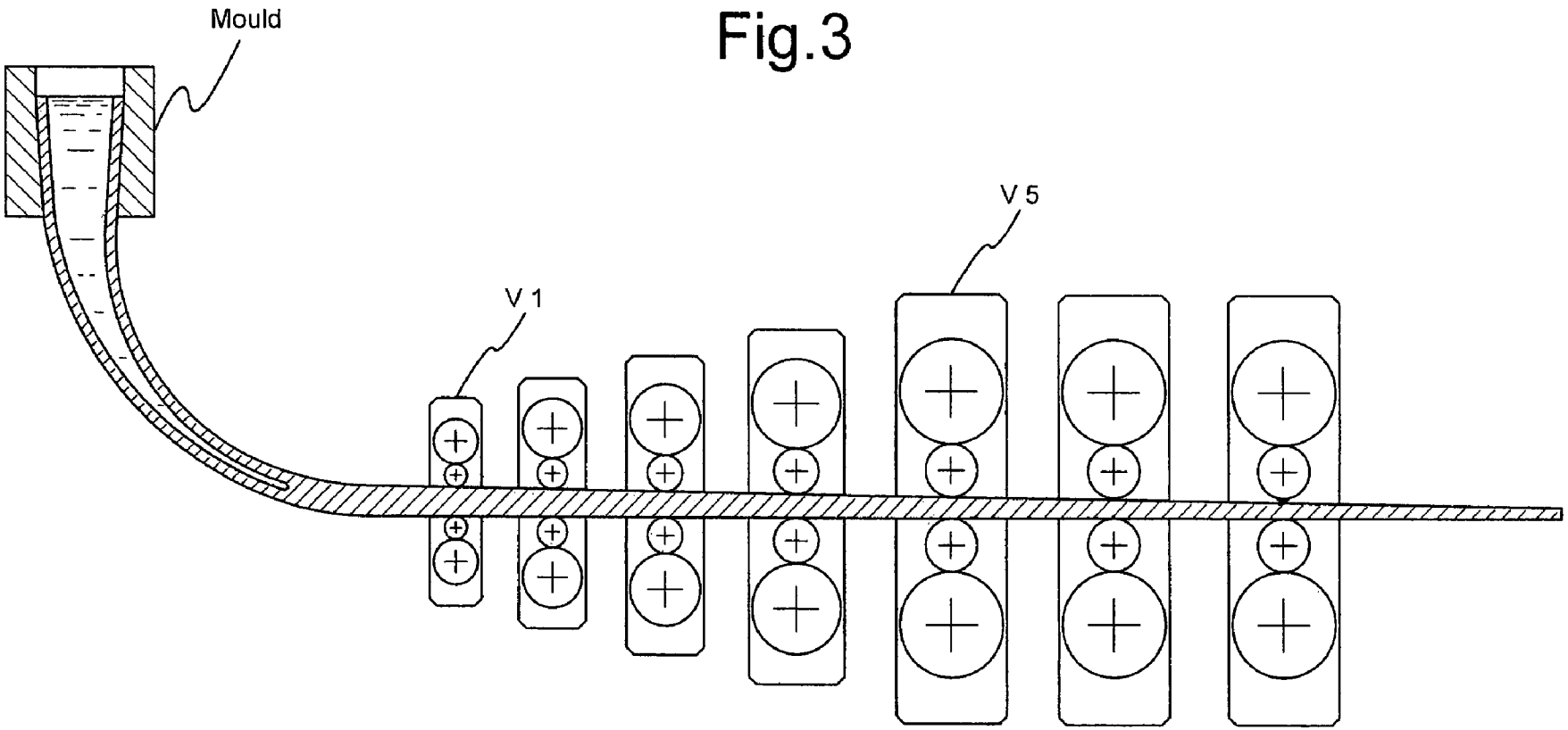
FIG. 3 schematically shows the thickness reduction from the mould until the last rolling stand.

It has been found that for the purposes of the present invention it is decisive that the flow of material or "mass flow" as defined above, has a high value in order to ensure temperatures and speed required by the rolling process for an end product having the desired values of thickness and of surface and inner quality and that the thickness reduction is increasing from the mould on. With reference to FIG. 3 the thickness reduction starts in the mould itself, wherein the slab undergoes a first reduction in its central portion where the crown is provided, goes on in the how caster, with the liquid core thickness reduction and ends with the last rolling stand. It should be remarked that in the reduction step during casting the feed speed of the material is constant.

Figure 2:
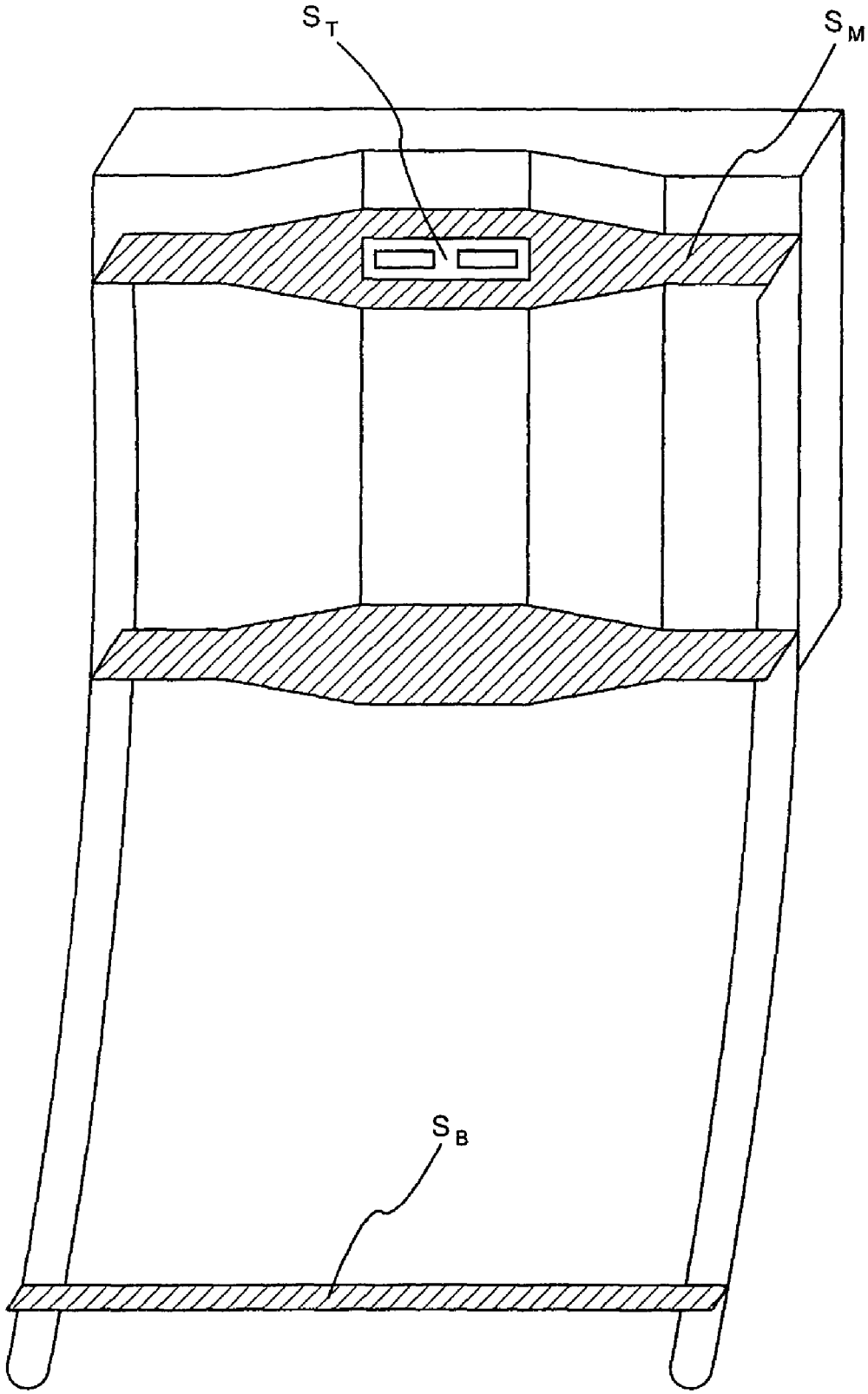
FIG. 2 schematically shows a continuous casting mould having preferred dimensional features according to the present invention.

It will be noted, with reference to FIG. 2, that the mass flow is proportional to the feed speed and to the section area $S_B$ of the slab. In particular to reach the above-mentioned object according to the invention optimal ratios have been defined between area $S_M$ of the liquid steel surface (or in general of the melt) in the mould, when taken in the horizontal cross-section corresponding to meniscus, upon subtracting the surface area $S_T$ interested by the submerged nozzle, and the vertical cross-section $S_B$ of the slab at the continuous casting outlet.

Such a ratio $S_M/S_B$ must be $\geqq 1.1$ in order to ensure restricted flow rates of the liquid steel (or in general of melt) and consequently the swirls in the mould and the meniscus waves are kept at a minimum.

On the other hand a greater flow rate of liquid metal also involves the necessity of a greater power of the secondary cooling of the slab. The prior art suggested to provide, to this effect, for an increase of the cooling water flow rate. However it has been found that an excessive increase of the water flow rate results in a difficult withdrawal of the water itself, that has the tendency to stagnate in front of the nozzles, with the consequence of preventing the cooling homogeneity which is instead necessary for a good quality of the end product. It has been found that by using values of water pressure comprised between 15 and 40 bar and a distance between nozzles and slab <150 mm, it is possible to obtain a more efficient cooling of the slab against a high value of the "mass flow", as well as a very good homogeneity of temperature (both in the transverse and longitudinal directions) required for a good quality of the end product. With the above-mentioned parameters, the water jet from the nozzles succeeds in fact to pass better through the vapor film generated, that has an isolating effect between slab and cooling water (Leidenfrost effect).

The secondary cooling, being controlled as described above, has the special feature of cooling the slab surface while keeping however the middle portion of the slab at the highest possible temperature.

The aim is that of keeping the average surface temperature of the slab at the continuous casting outlet <1150° C. to avoid the so-called "bulging" effect, i.e. a swelling of the slab between the caster rollers, causing irregularities at the meniscus and consequently negative effects on the product quality as well as in order to have, still at the caster exit, an average temperature in the middle cross-section of the slab being as high as possible and in any case >1300° C. in order to obtain, when rolling, the greatest reduction possible with the lowest separating force.

This occurs in favor of the process economy both in terms of lower investment (smaller stands) and of less power required for the same thickness of the end product. In this respect it should be noted that according to the present invention, contrary to what occurs in the prior art plants, a non excessive power demand is sufficient for obtaining even reduced final thicknesses, with values in kW being proportional to the slab thickness at the casting outlet (SpB). For example, with a slab with of 1600 mm the values of the required power for the first five stands are the following:

1° stand: $kW < SpB \times 20$

2° stand: $kW < SpB \times 40$

3° stand: $kW < SpB \times 70$

4° stand: $kW < SpB \times 85$

5° stand: $kW < SpB \times 100$

What stated above is reflected, by way of example, in FIG. 3 that shows, in a diagrammatic way and in correspondence with a progressive thickness reduction, also the increasing power consumption in the first five rolling stands, as indicated by the corresponding size of the each one of the stands.

By adopting a bow caster, the height of which is lower than in the vertical-type caster, the ferrostatic pressure at the inside of the solidifying slab is lower for the same cross-section area and speed from the continuous casting outlet, whereby the bulging effect can be avoided or reduced to a minimum.

Figure 1:
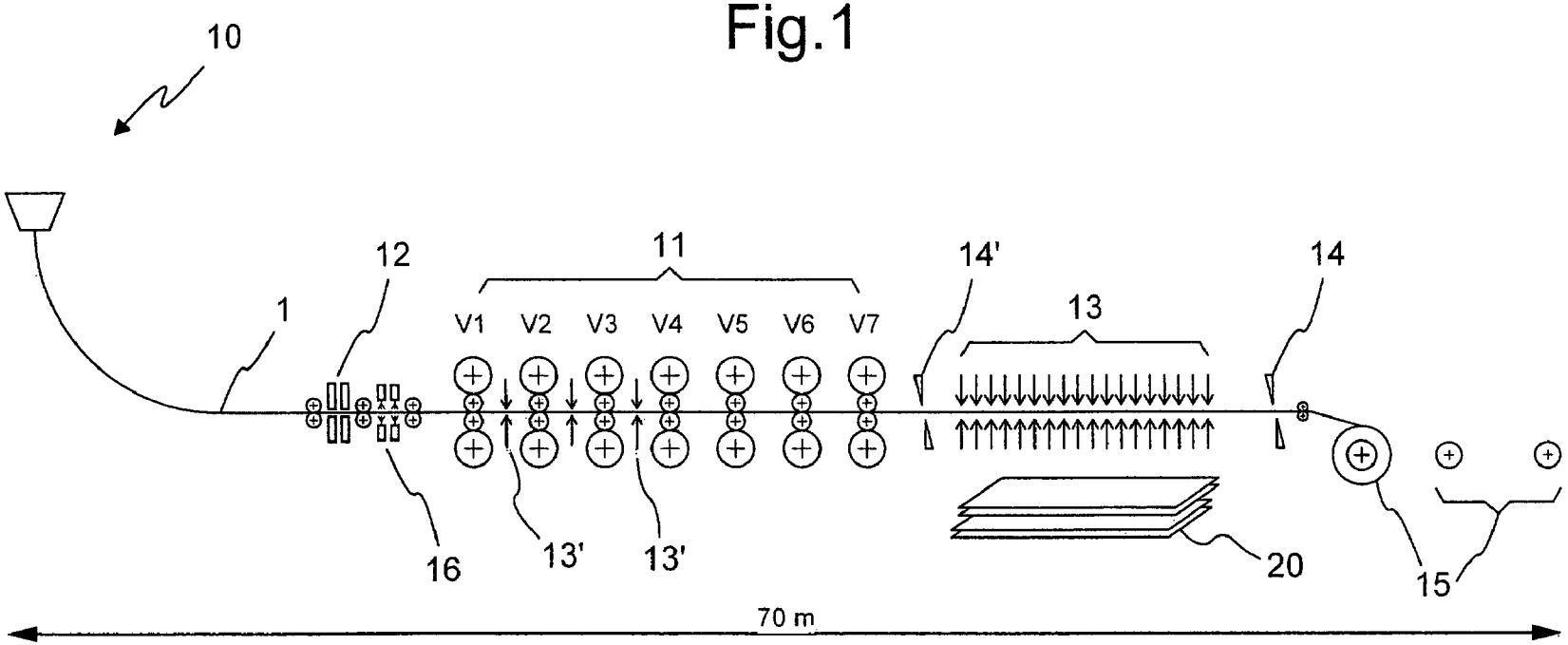
FIG. 1 schematically shows an example of a plant according to the invention for manufacturing steel strips being wound in coils, having minimum thickness until 1 mm or sheets of thickness up to a maximum of 100 mm.

With reference to FIG. 1 an example is given of a plant or lay-out according to the present invention, starting from the slab 1 at the outlet of a continuous casting through a mould referred to as 10. The slab 1, having thickness between 30 and 300 mm and width between 600 and 4000 mm, is directly fed to the rolling step 11 through an induction furnace 12 for heating the same upstream of the stands, as well as a descaler 16. The distance between the outlet of continuous casting and the first stand of rolling-mill 11 will not be greater than 50 m, in order to limit the temperature losses of the slab, thus leading to the additional advantage of having a more compact plant requiring more reduced space. The feed rate of the whole process from continuous casting to the last rolling stand is increasing and corresponds to the respective thickness reduction required by the desired end product, with the mass flow being constant. The in-line rolling-mill 11 consists of one or more stands for reaching the desired final thickness; for example the stands have been represented in FIG. 1 in number of seven (V1-V7). The stand rolls will have preferably a diameter in the range between 300 and 800 mm. Within this range an adequate reduction is obtained according to the end product thickness, as well as a very good cooling of each roll to avoid the development of the so-called "fire cracks".

The plant according to the invention, in particular the rolling-mill 11, but already from continuous casting 10, is provided with a system for controlling the speed in a downstream cascade, where there is provided a device 14 for cutting the coils being wound on an end reel, after a final cooling system 13. Upstream of the latter a cutting device 14', to be operated in alternative to the other, provides for a possible withdrawal of sheets 20 and could be positioned at a more upstream location, after a lower number of rolling stands with respect to those indicated in the drawing, when considering the higher thicknesses usually foreseen for the sheets (up to 100 mm) with respect to the strips.

It is further provided a controlled cooling system for cooling the sheets before the withdrawal device 14'.

In addition to the strip cooling system 13, upstream thereof, there is provided at least one cooling system for cooling the surface of slab 1, schematically shown in the drawing with opposite arrows (like in 13) between two adjacent rolling stands, to form a so-called interstand cooling 13' in order to limit the phenomenon of secondary re-oxidation.

As stated above, the feed rate of the whole process from continuous casting to the last rolling stand is increasing step by step and corresponds to the respective thickness reduction required by the features, especially thickness and quality, of the desired end product. To this effect there is provided a speed regulation system in cascade in the downstream direction starting from continuous casting, by introducing a regulation strategy that can be defined contrary to that adopted so far in the rolling-mills of the prior art, which was in cascade in the upstream direction.

Such a regulation in cascade to the upstream direction, if applied either to the plant of the present invention or to the processes and plants according to other patents (in particular EP 0889762), with continuous casting directly connected to the rolling step without discontinuity, would unavoidably cause a variation of the casting speed, with negative consequences on the features relating to the slab quality in terms of surface homogeneity and internal features of the material.

Therefore, by overcoming a general technical prejudice, a new concept of regulation in cascade to the downstream direction has been adopted, wherein the casting speed is preset and the possible speed corrections have effect on the speed parameters of the downstream stands, also taking into account the operative differences of the rolling-mill in a plant according to the invention with respect to the additional one. According to the prior art in fact the strip enters each stand when it is already closed, with a nip between rolls depending on the thickness required by the schedule pass, while the regulation in cascade in the upstream direction results in a correction of the speed at the stands already nipping the material. On the contrary, in the process and plant according to the present invention, the slab enters each stand with open rolls that close upon passing the slab head until reaching the nip corresponding to the required reduction.

An example of variation of the process parameters (thickness, reduction %, temperature and speed) is shown under the lay-out representation of FIG. 1 in correspondence with various positions at the inlet and outlet of the induction furnace 12, descaler 16 and rolling stands. To this effect there have been used notations IN and OUT in correspondence with the notations IH for the induction furnace and DES for the descaler, respectively, as well as V1-V7 for the various stands of FIG. 1. For these latter the values of the four outlet parameters only have been indicated, except for the first stand V1 of the rolling-mill, where also the inlet value has been given. In particular it can be noted how, according to the invention, when starting e.g. from a slab having initial thickness of 70 mm, with initial speed of 6.5 m/min, thicknesses of about 1 mm can be obtained with a plant having a total length of 70 m. It can also be noted that the values of the strip temperatures at the last stand outlet are such as to ensure a rolling in the austenitic phase.

Finally it will be recalled that the process according to the invention and the associate plant can be used also for manufacturing in continuous strips and sheets not only of carbon steel or stainless steel, but also of aluminum, copper or titanium.

The invention claimed is:

1. A process for manufacturing coiled metal strips and flat metal sheets comprising:

providing an apparatus comprising, in downstream order, a mould, an induction heating device, a rolling mill, a first cutting and withdrawing device, a cooling system, a second cutting device, and at least one coiling spool;

providing a speed control system in cascade and in the downstream direction starting from the mould outlet;

continuously casting a melt from the mould to produce a slab and subsequently thickness reducing the slab through rolling, wherein a quantity of material passing through an outlet of the mould has a mass flow corresponding to the slab thickness >30 mm and a speed >4 m/min, the outlet of the mould being bow-shaped from the mould with secondary cooling for obtaining at the outlet of the mould the slab with an inverted temperature gradient in its cross-section, with an average surface temperature of the slab <1150° C. and an average temperature at the core >1350° C., the process including a range of thickness reductions from the slab having a thickness between 30 and 300 mm and a width between 600 and 4000 mm to the coiled metal strips of a thickness in the range between 0.14 and 20 mm and the flat metal sheets of a thickness in the range between 10 and 100 mm, said thickness reduction beginning in the mould and continuing in a single manufacturing step of casting and rolling;

the process being performed without a break in continuity between the casting and the rolling, wherein the process and apparatus produce 1) the flat metal sheets through a final cutting and withdrawing step and 2) the coiled metal strips through a final coil winding step, the process further comprising:

wherein the flat metal sheets are formed upon controlled cooling of the thickness reduced slab with the cooling system and then cutting and withdrawing the cooled thickness reduced slab with the first cutting and withdrawing device, and the coiled metal strips are formed by coiling the thickness reduced slab on the at least one coiling spool and then cutting the coiled thickness reduced slab with the second cutting device.

2. A process according to claim 1, further comprising providing at least one controlled cooling step (13, 13) during and/or after said rolling step.

3. A process according to claim 1, wherein the process is carried out in a single rolling step without distinction between roughing and finishing and without any need of providing a heating/cooling step therebetween.

* * * * *